US010702752B2

(12) United States Patent
Rimback

(10) Patent No.: US 10,702,752 B2
(45) Date of Patent: Jul. 7, 2020

(54) GOLF BALL STOPPING DEVICE FOR SIMULATING A PUTTING GREEN HOLE

(71) Applicant: Peter D. Rimback, Cleveland, OH (US)

(72) Inventor: Peter D. Rimback, Cleveland, OH (US)

( * ) Notice: Subject to any disclaimer, the term of this patent is extended or adjusted under 35 U.S.C. 154(b) by 0 days.

(21) Appl. No.: 16/579,046

(22) Filed: Sep. 23, 2019

(65) Prior Publication Data

US 2020/0016463 A1 Jan. 16, 2020

Related U.S. Application Data

(63) Continuation-in-part of application No. 15/857,999, filed on Dec. 29, 2017, now Pat. No. 10,478,701.

(60) Provisional application No. 62/498,652, filed on Jan. 4, 2017.

(51) Int. Cl.

| | |
|---|---|
| ***A63B 69/36*** | (2006.01) |
| ***A63B 57/30*** | (2015.01) |
| ***A63B 63/00*** | (2006.01) |

(52) U.S. Cl.

CPC ..... *A63B 57/30* (2015.10); *A63B 63/00* (2013.01); *A63B 69/3676* (2013.01)

(58) Field of Classification Search

CPC ..... A63B 69/3676; A63B 57/40; A63B 63/00; A63B 67/02; A63B 57/357; A63B 69/3661; A63B 2210/50; A63B 63/007; A63B 2225/09; A63B 57/00; A63B 69/36; A63B 71/04; A63B 2102/32; A63B 67/002; A63B 71/022; A63B 47/00; A63B 59/20; A63B 2024/0037; A63B 47/02; A63B 57/20; A63B 57/405; A63B 65/122; A63B 67/066

USPC ..... 473/157, 174, 186–189, 195

See application file for complete search history.

(56) References Cited

U.S. PATENT DOCUMENTS

| | | | | |
|---|---|---|---|---|
| 1,529,749 A * | 3/1925 | Morrison, Jr. | ..... | A63B 69/3676 473/188 |
| 3,184,240 A * | 5/1965 | Gleeson | ..... | A63B 57/40 473/188 |
| 3,313,544 A * | 4/1967 | Davis | ..... | A63B 57/40 473/188 |
| 3,458,202 A * | 7/1969 | McNamara | ..... | A63B 71/04 473/188 |

(Continued)

OTHER PUBLICATIONS

Dead Zero, "Dead Zero Putting Disk," www.deadzeroputting.com, published May 8, 2013.

(Continued)

*Primary Examiner* — Nini F Legesse

(74) *Attorney, Agent, or Firm* — Emerson, Thomson & Bennett, LLC; Roger D. Emerson

(57) ABSTRACT

The present disclosure is directed to a novel golf ball stopping device. The golf ball stopping device includes an upper plate, set at a height so it slows or stops a golf ball which rolls under the plate. The underside of the plate includes a material and structure that provides resistance to the golf ball as it contacts the device. The plate may be supported by a center post or an extension arm located along the side of the plate. The center post and extension arm fit together with a base and are adjustable to the base so the plate can be positioned at a desired height. The base is designed to achieve the optimal friction on the golf ball and to provide stability to the device.

20 Claims, 20 Drawing Sheets

(56) References Cited

U.S. PATENT DOCUMENTS

| | | | | |
|---|---|---|---|---|
| 3,909,007 | A * | 9/1975 | Wuertemburg | A63B 69/3676 473/188 |
| 4,896,886 | A * | 1/1990 | Colley | A63B 69/3676 473/157 |
| 5,257,808 | A | 11/1993 | Mueller | |
| 6,595,864 | B2 * | 7/2003 | Fuller | A63B 57/00 473/188 |
| 7,780,539 | B2 * | 8/2010 | Whitefield | A63B 63/06 473/188 |
| 8,870,672 | B2 | 10/2014 | Downing | |
| 9,010,757 | B2 * | 4/2015 | Stevens Kang | A63B 57/357 273/127 B |
| 10,478,701 | B2 * | 11/2019 | Rimback | A63B 63/00 |
| 2002/0193172 | A1 * | 12/2002 | Fuller | A63B 57/00 473/195 |
| 2004/0185953 | A1 | 9/2004 | Carilli | |
| 2013/0221615 | A1 * | 8/2013 | Stevens Kang | A63B 57/357 273/127 B |

OTHER PUBLICATIONS

Putters.com, "The Putting Lane—Azimuth Golf System Training Aid," http://www.putters.com/The-Putting-Lane—Azimuth-Golf-System-Training-Aid_p_120.html, pulished 2010.

CS2 Target Putting Cup, "CS2 Putting Cup," https://www.youtube.com/watch?v=cif8UVPzFsQ, published Feb. 4, 2015.

Putt-A-Round Putting Aid—Perfect Custom Golf Gift, Tournament Prize, https://puttaroundgolf.com, published Oct. 15, 2016.

* cited by examiner

GOLF BALL STOPPING DEVICE FOR SIMULATING A PUTTING GREEN HOLE

CROSS-REFERENCE TO RELATED APPLICATIONS

The present application claims priority to, and is a continuation-in-part of, application Ser. No. 15/857,999, filed on Dec. 29, 2017, which in turn claims the benefit of U.S. Provisional Application No. 62/498,652, filed on Jan. 4, 3017.

TECHNICAL FIELD

The present disclosure relates to golf putting accessories, and more particularly to a device to stop a rolling golf ball and thereby simulate a hole on a putting green and the like.

BACKGROUND

Putting accessories have been a popular tool for golfers to practice putting in the convenience of their home and/or in the off-season. It is desirable to vary the putting distance and surface contour to realistically simulate the challenges faced on a green at a golf course and thus improve the putting skill of a golfer. There are many types of putting practice accessories which vary in realism, cost, and ease of use, and user enjoyment.

Putting practice devices fall under two the main categories of single-direction and multi-direction.

Single-direction devices consist of one of various types of target for the ball, some of which include a return mechanism and a carpet. Sometimes the target end is raised up so the ball can fall into a hole, then follow a track to return to the starting place. This is unrealistic to putting on the green of a golf course because the area around a hole on a green is not raised a few inches from the remainder of the green. On other units the entire putting area is raised, so the putting surface is flat and the ball falls into a hole. The disadvantage to this is that it makes the unit very bulky. Putting in a straight line can quickly become rote and thus bore the user. It does not promote the variety required to imitate putting on a golf course.

Multi-direction putting devices are also referred to as artificial putting greens. Some have actual holes and can be used indoor or outdoor. If they are used outdoors, extensive work, materials, and money are required to provide water drainage, and to smooth and prepare an area. If these artificial greens are used indoors, a raised platform must be built. Additional time, cost and materials are required in order to include a contoured surface to the platform. While artificial greens are the most similar to a golf course green, the cost and effort to establish them are a disadvantage.

Another category of putting hole simulators is a stand-alone, ball stopping device. The disclosed invention falls within this category. Most of these devices are ring-shaped and rely on trapping the ball within the ring. However if the ball strikes the ring on the far left or far right edge, it is likely to bounce off and not enter the ring. This has the opposite effect of a hole in a putting green, and is therefore not realistic.

One patent pending device on the market which is a solid metal puck, which is used as a putting target. The device is approximately half the diameter of a putting hole. It does not stop the ball, therefore it is not as accurate in depicting whether the ball would have fallen into a putting green hole.

Presently, there is no solution which is easy to set up, versatile, accurately simulates a putting hole, and can be used as a game.

SUMMARY

The following is intended to be a brief summary of the invention and is not intended to limit the scope of the invention. The present invention comprises a novel golf ball stopping device generally consisting of an upper plate, set at a height so it slows or stops a golf ball which rolls under the plate. The underside of the plate may consist of a material and structure that provides resistance to the golf ball. The plate may be supported by a center post, so the golf ball can be aimed at the invention from any direction and perform the same function. The center post fits together with a base, and is adjustable to the base so the plate can be positioned to a desired height. The base may be weighted to achieve the optimal friction on the golf ball and to provide stability to the invention. The base may consist of downward facing protrusions in order to grip the surface on which it is set and keep the invention from spinning when a golf ball rolls under the invention near the outer edge.

Provided is a putting practice aid for stopping a rolling golf ball by trapping the ball from above. According to certain aspects of the present teaching, the putting practice aid includes: an upper plate having approximate size of a putting hole; flexible bristles on the underside of the plate which brush against the top of a golf ball if it rolls under the plate; a post receiving unit extending downward from the center of the plate; a post having a top portion which connects to the post receiving unit and a bottom portion which connects to a base, wherein the base is connected to the bottom portion of the post, wherein the base can be set at different heights along the post, in order to allow the plate to be positioned at various heights with respect to a surface; a weight inside the base in order to prevent unwanted tipping and to provide increased friction to the golf ball; and downward pointing teeth along the outer edge of the bottom portion of the base, so as to assist the base to grip a carpet or green-like surface.

According to further aspects of the present teaching, the putting practice aid is placed on a ground surface, a carpet or an artificial green-like surface to simulate multiple putting green holes and create a putting practice area and course for putting games.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION

Figure 1:
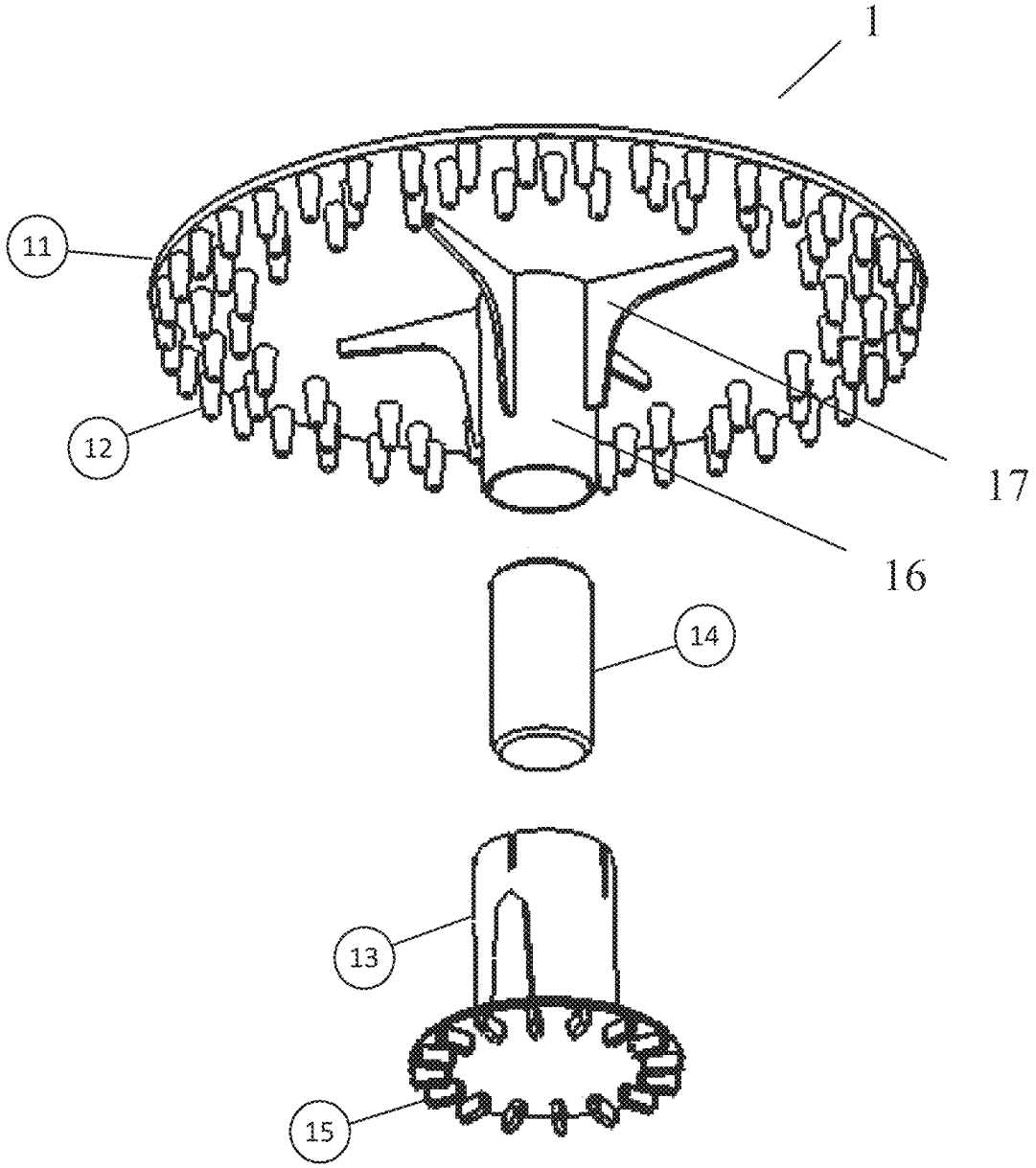
FIG. 1 shows an exploded perspective view of a first working example.

The golf ball stopping device will now be described by referencing the appended figures which represent exemplary embodiments. FIG. 1 depicts an exploded perspective view of the component parts of a device for stopping a rolling golf ball according to certain embodiments of the present disclosure. The device shown in FIG. 1 stops a rolling golf ball by contacting the top of the ball.

The component parts of the golf ball stopping device 1 shown within FIG. 1 will now be described in greater detail. As shown within FIG. 1, the top of the golf ball stopping device includes a plate 11 having a top side and bottom side. This plate may also be referred to as a stopping plate 11. The stopping plate 11 provides a target for the player to aim at as he or she hits a golf ball towards the device. In certain embodiments, the stopping plate 11 is designed to approximate the size of a putting green hole. The stopping plate 11 stops a golf ball which passes under the bottom side of the plate 11.

The stopping plate 11 may have a variety of surface features 12 such as textures, protrusions or any type of materials on the surface of the bottom side of the plate 11 to assist in stopping the ball. In the embodiment shown within FIG. 1, the bottom side of the stopping plate includes soft flexible bristles 12 to slow and stop the ball. However, it is understood that the surface feature on the bottom side of the plate 11 may be formed from any type of material and may be any shape and size within the sound judgement of a person of ordinary skill in the art for stopping the ball. According to certain aspects of the present teaching, the surface features or bristles 12 may be positioned towards the outer edge on the bottom side of the plate 11 as shown within FIG. 1. In such embodiments, the interior portion of the bottom side of the plate may not include any surface features or bristles 12 or may include fewer surface features or bristles 12 than on the outer edge on the bottom side of the plate 11. This allows surface features or bristles 12 to trap the ball as it passes under the device and allows the ball to fit snuggly between the surface features or bristles 12 and the surface on which the golf ball stopping device is sitting on or the surface on which the ball rolls or rests on.

The stopping plate 11 is elevated from the putting surface by a post 14 which is connected to a post receiving unit 16 on the bottom side of the stopping plate 11. As shown within FIGS. 1 and 2, the post receiving unit 16 on the stopping plate 11 includes reinforcement brackets 17 to secure the post receiving unit 16 to the stopping plate 11. In certain embodiments, the post 14 has a first end which fits within an opening within the post receiving unit 16 on the stopping plate 11 and a second end which fits an opening within a base 13 of the golf ball stopping device 1. However, it is understood that the post receiving unit 16 on the stopping plate 11 and the base 13 of the golf ball stopping device 1 may be designed to fit within the respective openings within the post 14. According to certain aspects of the present teaching, the post 14 can be adjustable allowing the stopping plate 11 to be positioned at various heights from the ground surface. This allows the golf ball stopping device 1 to accommodate different putting surfaces, putting surface materials or carpets of varying thicknesses. Adjustment of the height of the golf ball stopping device 1 may be accomplished by positioning the stopping plate 11 and the base 13 at various points along the length of the post 14. According to certain embodiments, the post 14 may be extended or retracted in a telescoping manner to adjust the length of the post 14. The height of the golf ball stopping device 1 may also be adjusted by swapping out the post 14 with a post 14 having a different length.

As mentioned above, the golf ball stopping device 1 includes a base 13 which supports the post 14 at various heights. The base 13 has a lower flange that provides stability to the unit as it is positioned on the ground surface. A weight (not shown) may be positioned inside the base 13 and post 14 to provide a downward force or pressure to assist in stopping the ball. The weight also serves to help keep the unit from falling over too easily. In certain aspects of the present teaching, it is desirable for the golf ball stopping device 1 to fall over when the ball is rolling so fast that it would roll over a hole on a standard putting green.

The bottom surface of the lower flange of the base 13 includes a plurality of feet 15 which grip the putting green surface and assist in keeping the unit from spinning, especially if the ball tangentially contacts the bristles on the far left or the far right portions of the plate 11 and does not directly hit the golf ball contact device.

Figure 2:
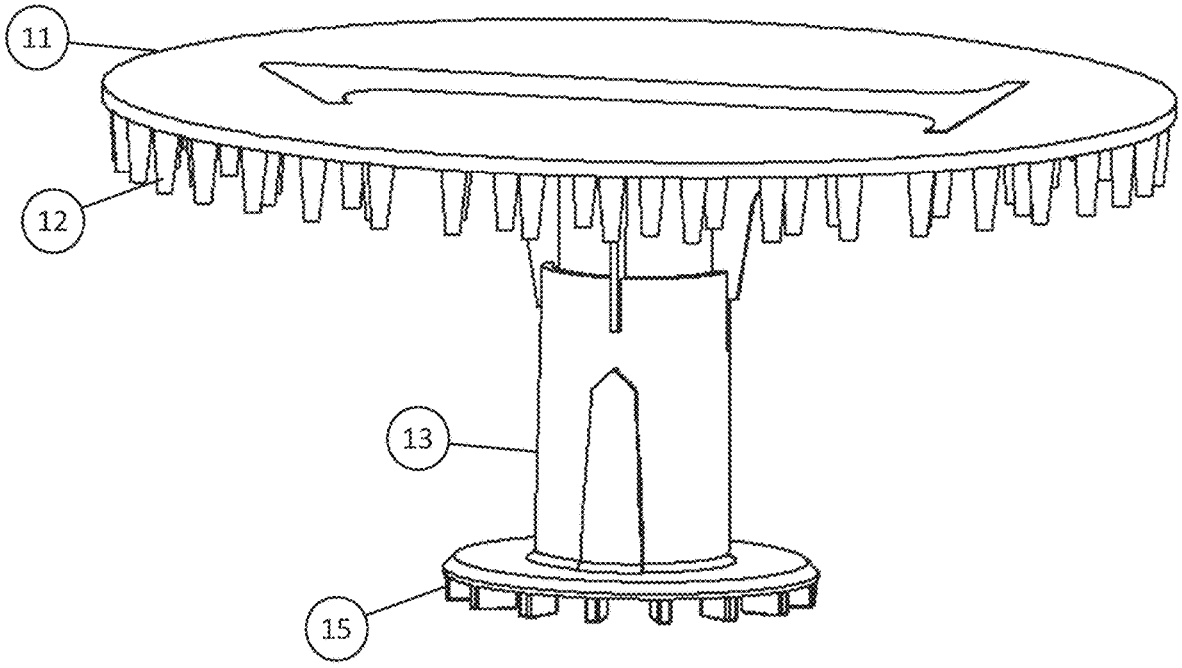
FIG. 2 shows a perspective view of the assembled working example of FIG. 1.
Figure 3:
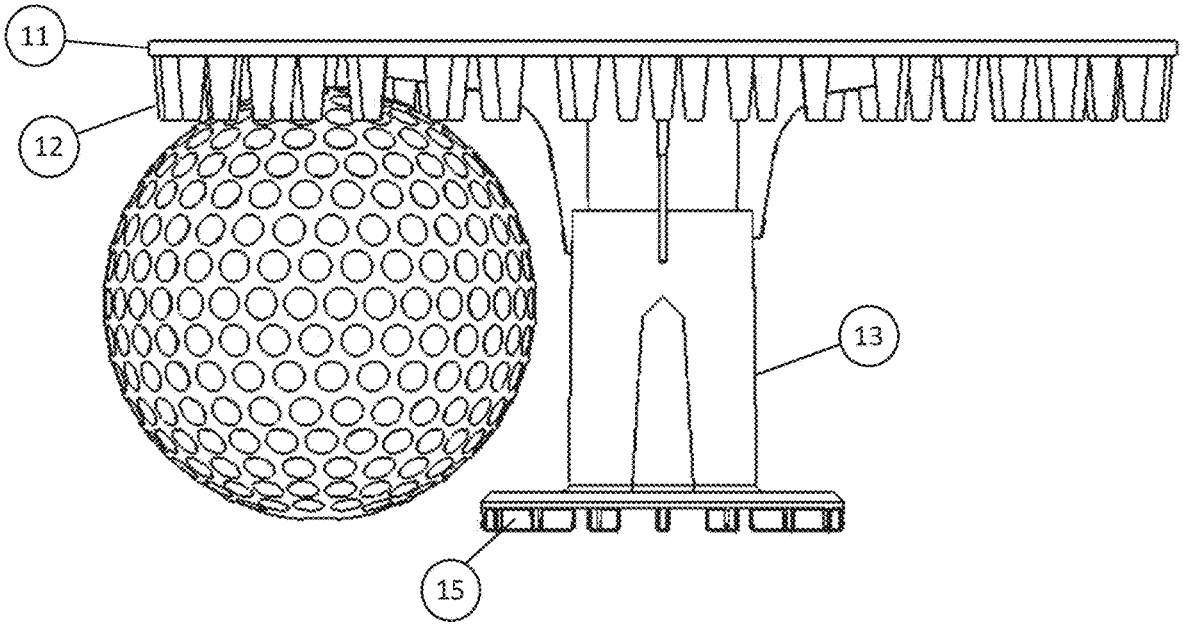
FIG. 3 shows a side view of the assembled working example of FIG. 1 with a golf ball under the plate.
Figure 4:
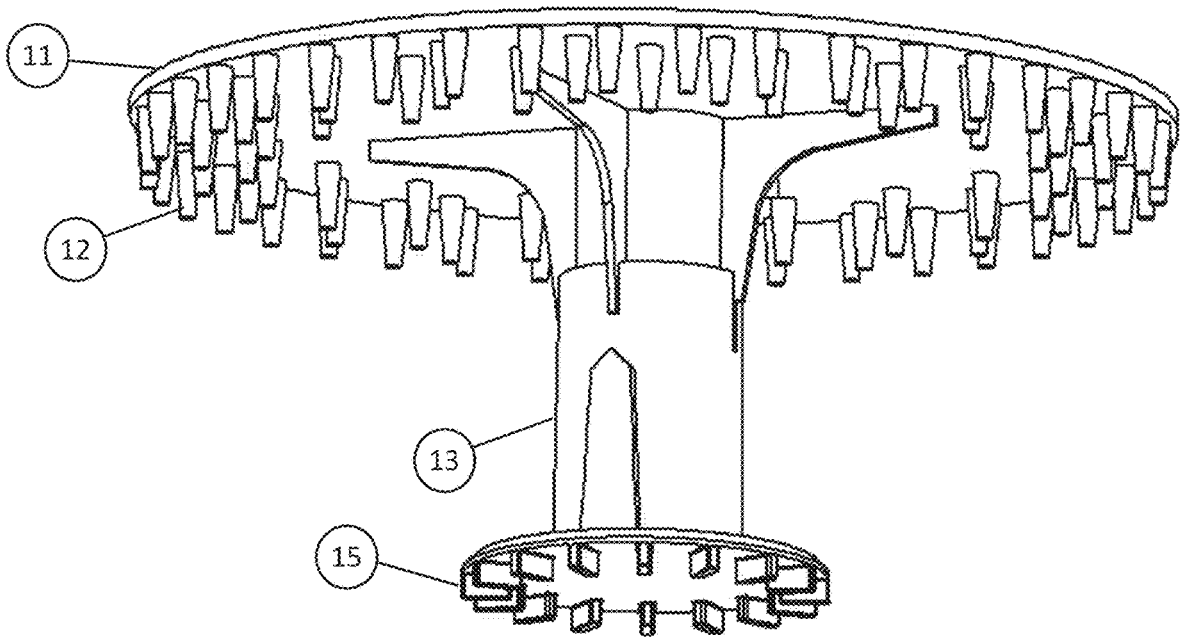
FIG. 4 shows a perspective lower view of the assembled working example of FIG. 1.

FIGS. 2 and 4 show an assembled perspective view of the golf ball stopping device 1 shown within FIG. 1. FIG. 3 shows a side view of the golf ball stopping device 1 with a golf ball trapped under the stopping plate 11.

Figure 5:
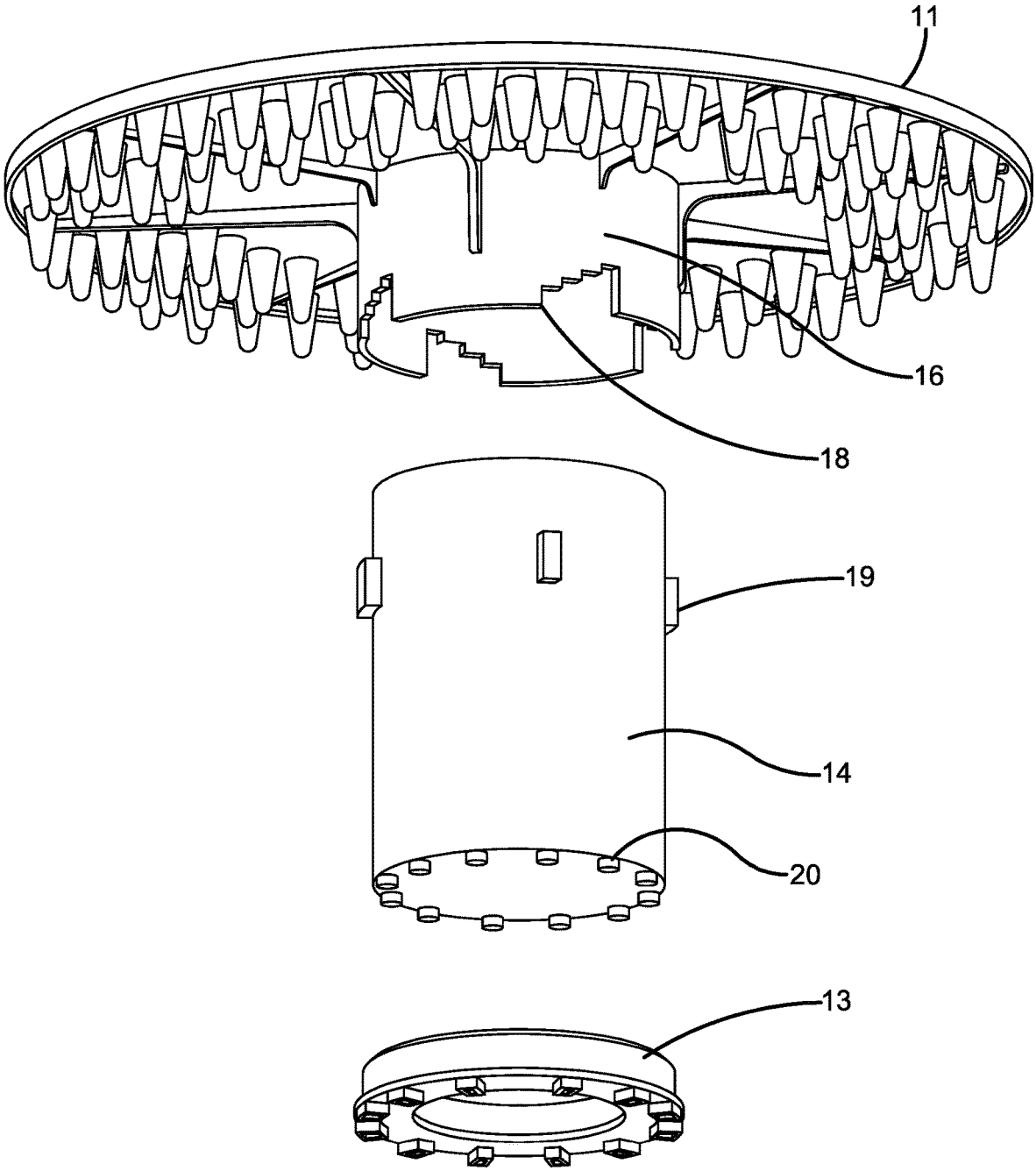
FIG. 5 shows an exploded perspective view of a second working example.
Figure 6:
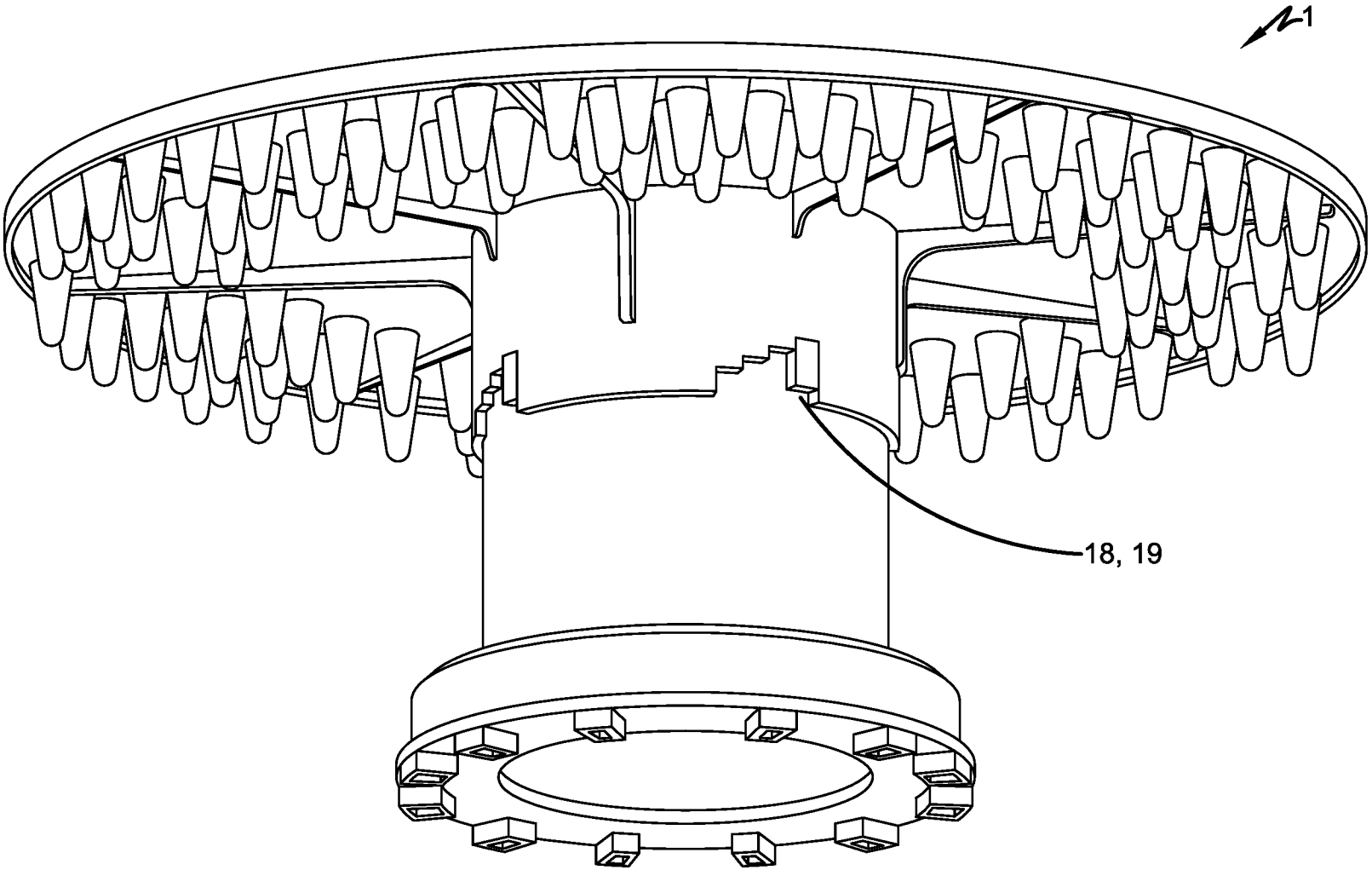
FIG. 6 shows a perspective lower view of the assembled working example of FIG. 5.

FIGS. 5 and 6 illustrate an alternate embodiment of the golf ball stopping device 1. In this embodiment, the post receiving unit 16 on the bottom side of the stopping plate 11 includes a step cutout 18 for receiving a first tab 19 positioned on the outer surface at the top end of the post 14. This allows the stopping plate 11 to be locked into position with respect to the top end of the post 14. The bottom surface of the post 14 includes a second tab 20 which is designed to fit within a tab receiving end (not shown) on the top surface of the base 13. This allows the bottom end of the post 14 to be locked into position with respect to the top end of the base 13. It is understood that the golf ball stopping device 1 may include any number of step cutouts 18, first tabs 19 and second tabs 20 as deemed suitable for use by a person of ordinary skill in the art.

Figure 7:
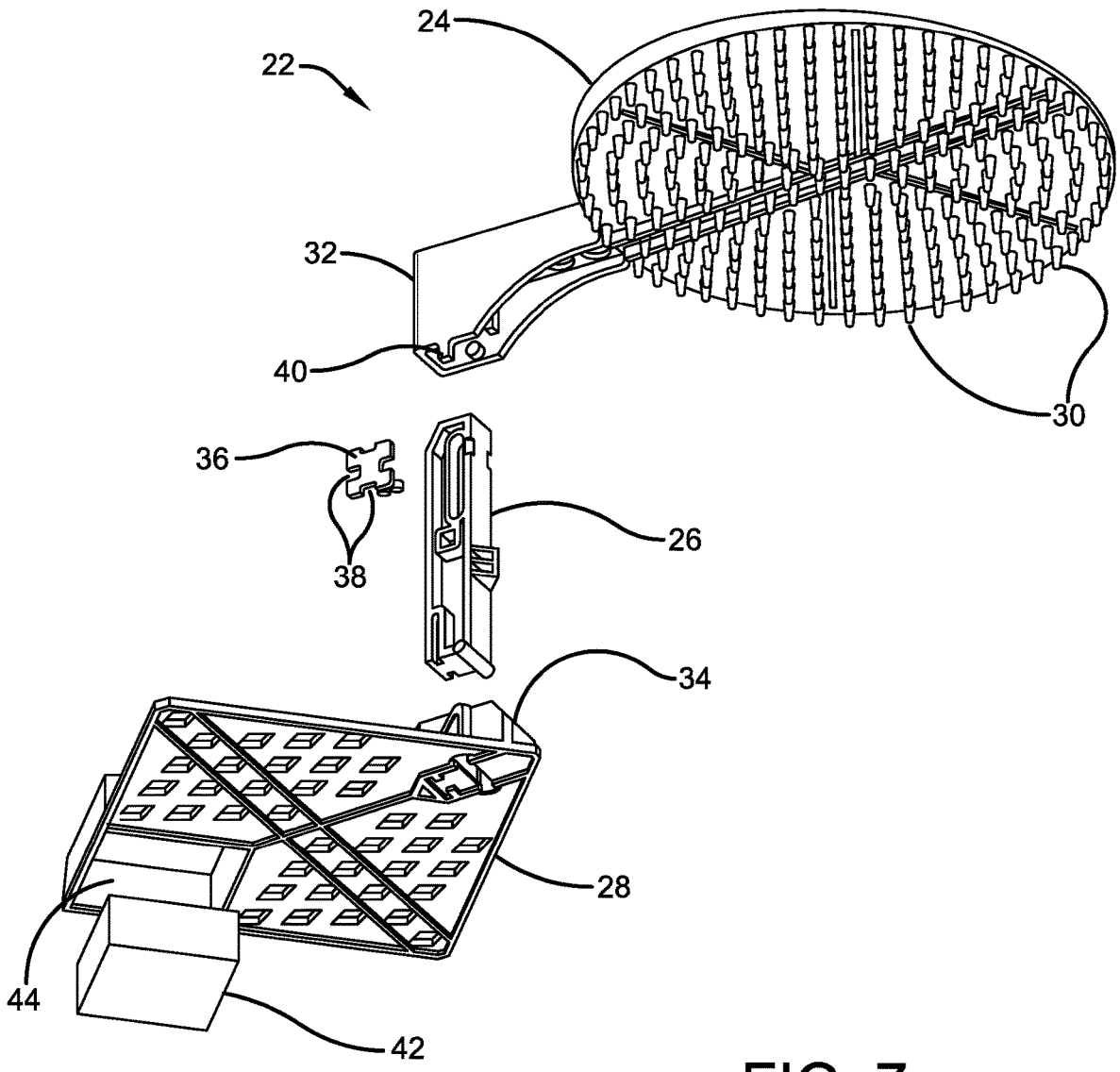
FIG. 7 shows an exploded view of an alternative embodiment of the golf ball stopping device.

With reference now to FIG. 7, an alternative embodiment of the golf ball stopping device is shown, collapsible stopping device 22. The collapsible stopping device 22 is comprised of an upper plate 24, an extension arm 26, and a base 28. The upper plate 24 is similar to that of the stopping plate 11 discussed above, in that the upper plate 24 may be of similar design, dimensions, and purpose as that of the stopping plate 11. The upper plate 24 is further equipped with underside surface features 30. The underside surface features 30 are similar to that of the surface features 12 discussed above, in that the underside surface features 30 may be of similar design, dimensions, and purpose as that of the surface features 12. The base 28 may be generally rectangular in nature, with sufficient surface area to provide for a stable support upon which the extension arm 26 and upper plate 24 may be inserted.

With continued reference to FIG. 7, positioned about an outer edge of the upper plate 24 is a first pivot connection point 32. The first pivot connection point 32 may be of any general configuration as identified by those having skill in the art for receiving the extension arm 26 in such a manner so as to allow a pivotable relation between the two components. According to the embodiment shown in FIG. 7, the first pivot connection point 32 is comprised of two opposing faces that extend outward and away from the upper plate 24. The two opposing faces are capable of receiving the extension arm 26 at an approximately perpendicular relation with regards to the upper plate 24. The upper plate 24 is capable of pivoting about the first pivot connection point 32 such that the upper plate 24 is drawn in towards the extension arm 26. The base 28 equipped with a second pivot connection point 34, similar in structure and design to that of the first pivot connection point 32 affixed to the upper plate 24. The opposing distal end of the extension arm 26 is received by the second pivot connection point 34 so as to create a pivotable relation between the two components. The extension arm 26 is capable of pivoting about the second pivot connection point 34 such that the extension arm 26 extends to a position substantially parallel to that of the surface of the base 28.

A locking pin 36 may be used to secure the configuration of the collapsible stopping device 22. The locking pin 36 may be any such device as identified by those having skill in the art for locking the first and second pivot connection points 32, 34 in place. According to the embodiment shown in FIG. 7, the locking pin 36 is a generally square-shaped member having four notches located about each of the respective four corners. The configuration of the notches creates a series of four receiving openings 38 about the perimeter of the locking pin 36. The length of the notches, measured by their respective extension from the center of the locking pin 36, results in the various receiving openings being of different depths. The different depths of the receiving openings 38 allows for various height adjustment settings for the collapsible stopping device 22. The locking pin 36 may have any different combination of depths of the various receiving openings 38.

With continued reference to FIG. 7, by rotating the orientation of the locking pin 36, a user may select the receiving opening 38 that they wish to use to set the height of the upper plate 24 above the ground surface. The locking pin 36 is rotated to select the desired receiving opening 38. The selected receiving opening 38 is then aligned with the securement tab 40, located on the first pivot connection point 32 of the upper plate 24. The securement tab 40 may be generally defined as a protrusion from the first pivot connection point 32 that is generally rectangular shape. The securement tab 40 inserts into the selected receiving opening 38 to secure the upper plate 24 at a selected height and thereby "locking" the pivotable relation between the upper plate 24 and the extension arm 26. The various depths of the receiving openings 38 correspond to the different height setting at which the upper plate 24 may be set: a shallow receiving opening 38 will correspond with a lower height setting of the upper plate 24, and a deeper receiving opening 38 will correspond to a higher height setting of the upper plate 24.

In order to help reduce any unwanted movement in the collapsible stopping device 22 during use, the collapsible stopping device 22 may have at least one stabilizing unit, such as anchor weight 42. The anchor weight 42 may be any weight-bearing object as identified by those having skill in the art for stabilizing the collapsible stopping device 22 to the ground surface upon which it is placed. According to the embodiment shown in FIG. 7, the anchor weight 42 is a block weight. The anchor weight 42 may be inserted into a weight receiving slot 44 located about the underside of the base 28. The weight receiving slot 44 may be a cutout on the underside of the base 28 that also extends vertically upward and away from the surface of the base 28 so as to house the anchor weight 42.

Figure 8:
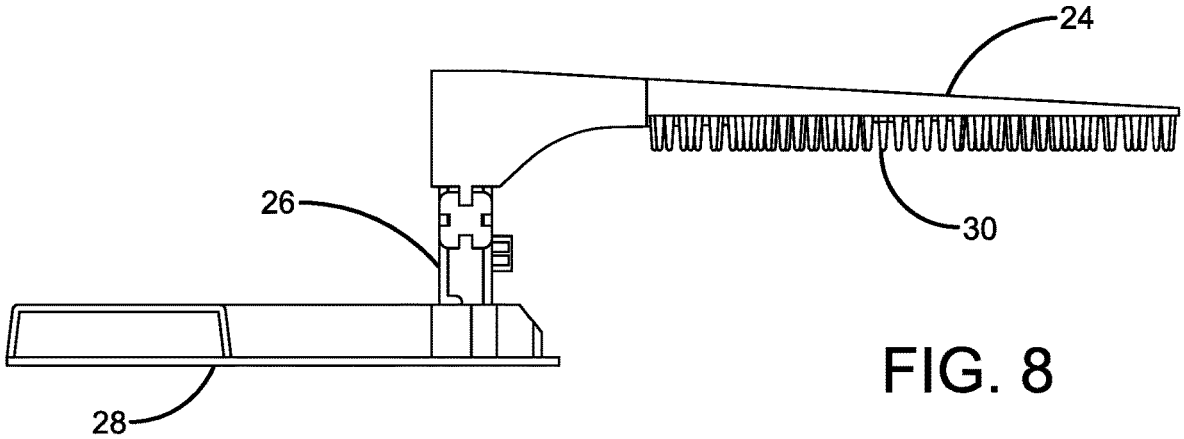
FIG. 8 shows a side profile of the embodiment shown in FIG. 7.
Figure 9:
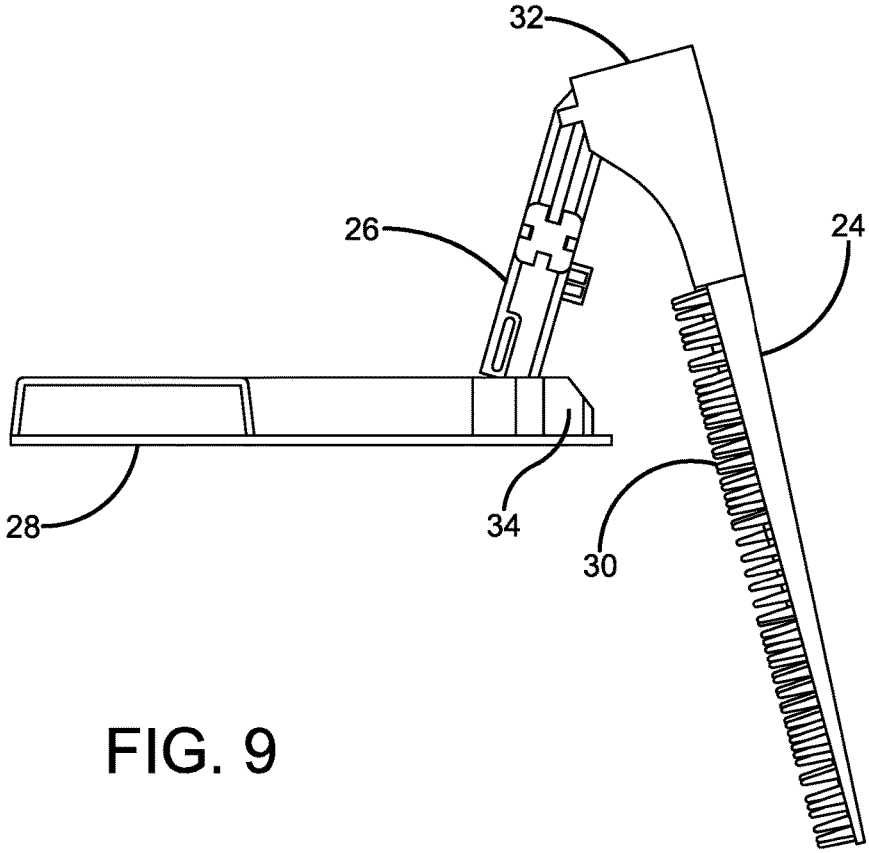
FIG. 9 shows a side profile of the golf ball stopping device shown in FIGS. 7 and 8 in a partially-collapsed state.

With reference now to FIG. 8, a side profile of the collapsible stopping device 22 is shown. The upper plate 24 is shown affixed to the extension arm 26, raising the upper plate 24 upward and away from that of the base 28. The underside surface features 30 are shown positioned about the underside of the upper plate 24. With reference now to FIG. 9, the collapsible stopping device 22 can be shown in a partially collapsed state. The locking pin 36 may be withdrawn from the device in order to allow freedom of motion about each of the respective first and second pivot points, 32, 34. When collapsing the collapsible stopping device 22, the upper plate 24 is brought in a downward direction towards the base 28 about the first pivot connection point 32. Either independently or simultaneously, the extension arm 26 may be brought in a downward direction towards the base 28 about the second pivot connection point 34.

Figure 10:
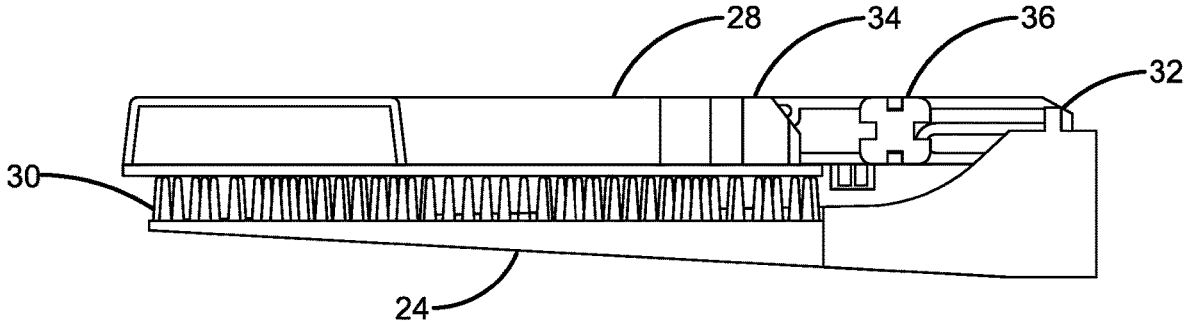
FIG. 10 shows a side profile of the golf ball stopping device shown in FIGS. 7-9 in a fully-collapsed state.

With reference now to FIG. 10, the collapsible stopping device 22 is shown in a fully collapsed state. The extension arm 26 is fully rotated about the second pivot point 34 so as to be substantially parallel with that of the base 28, and the upper plate 24 is fully rotated about the first pivot point 32 so as to be substantially parallel with the base 24. When in the fully collapsed state, the underside surface features 30 are oriented such that they contact, or nearly contact, the underside of the base 24, with the underside of the base 24 being defined as the surface that would be positioned on the ground surface during operation when configured according to the functioning ("un-collapsed") state. The locking pin 36 may be reinserted to lock the collapsible stopping device in the collapsed state.

Figure 11:
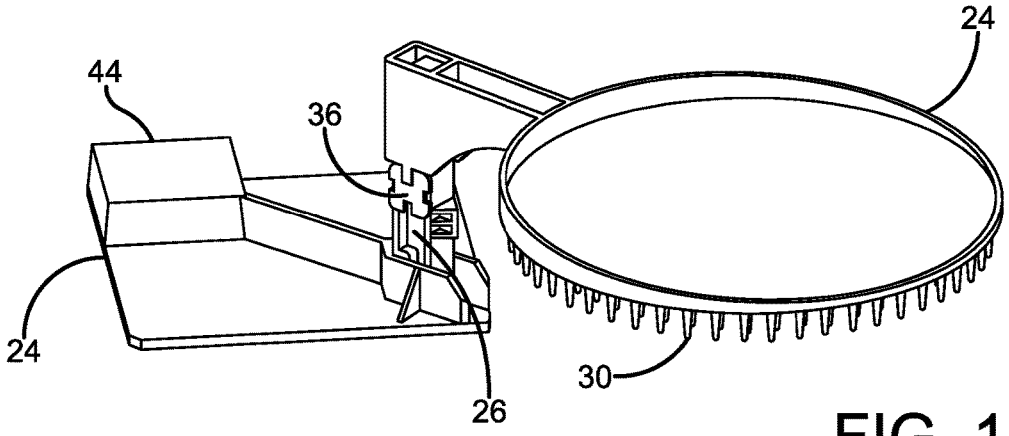
FIG. 11 shows a perspective view of an alternative embodiment of the golf ball stopping device.
Figure 12:
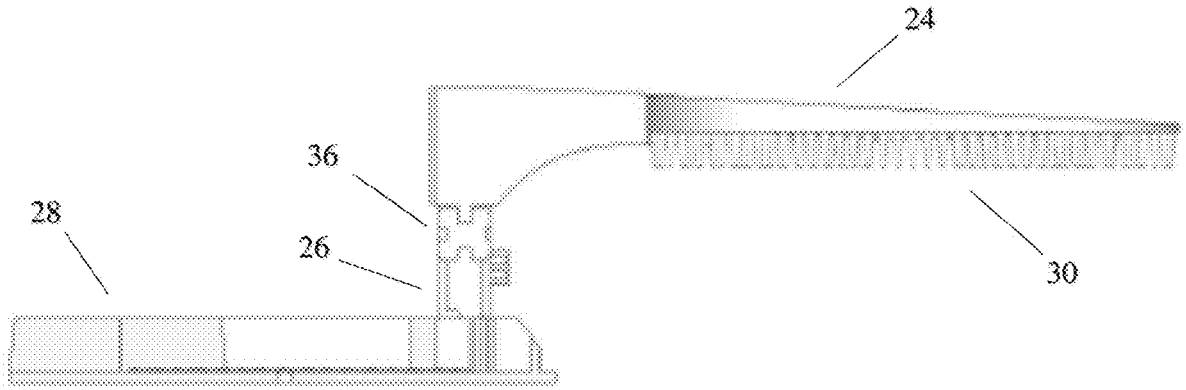
FIG. 12 shows a side profile of the embodiment shown in FIG. 11.
Figure 13:
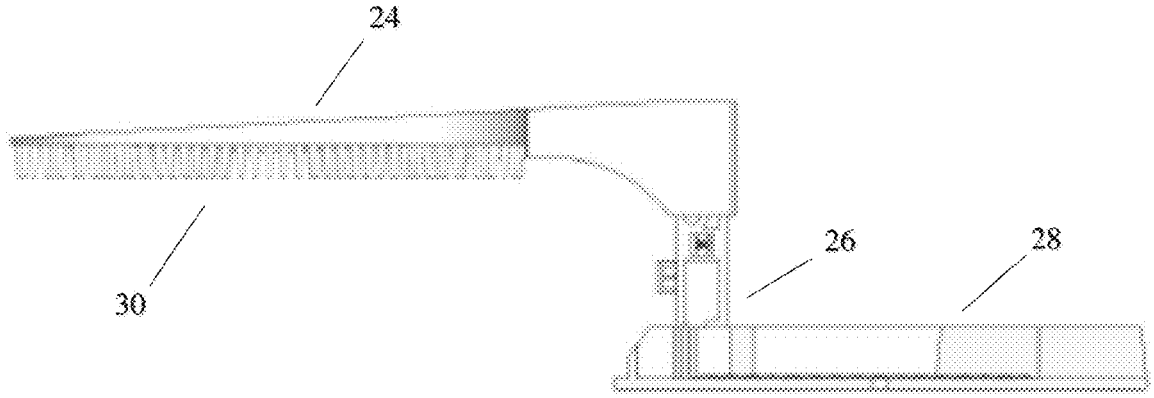
FIG. 13 shows an alternative side profile of the embodiment shown in FIGS. 11 and 12.
Figure 14:
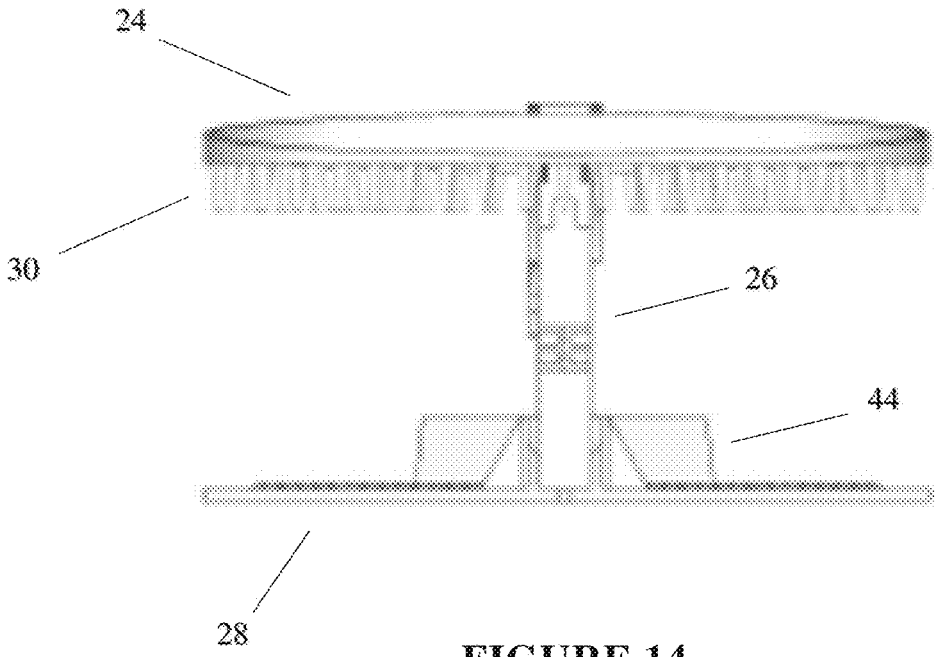
FIG. 14 is a front view of the embodiment shown in FIGS. 11-13.
Figure 15:
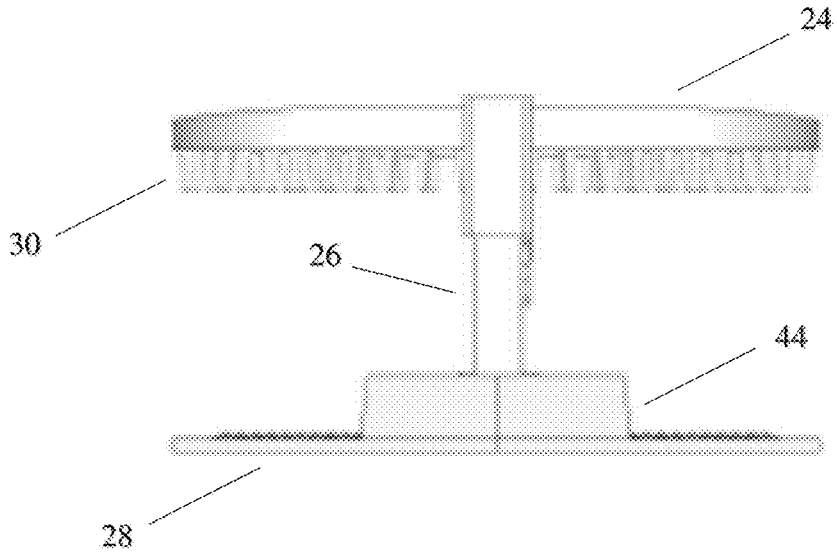
FIG. 15 is a back view of the embodiment shown in FIGS. 11-14.
Figure 16:
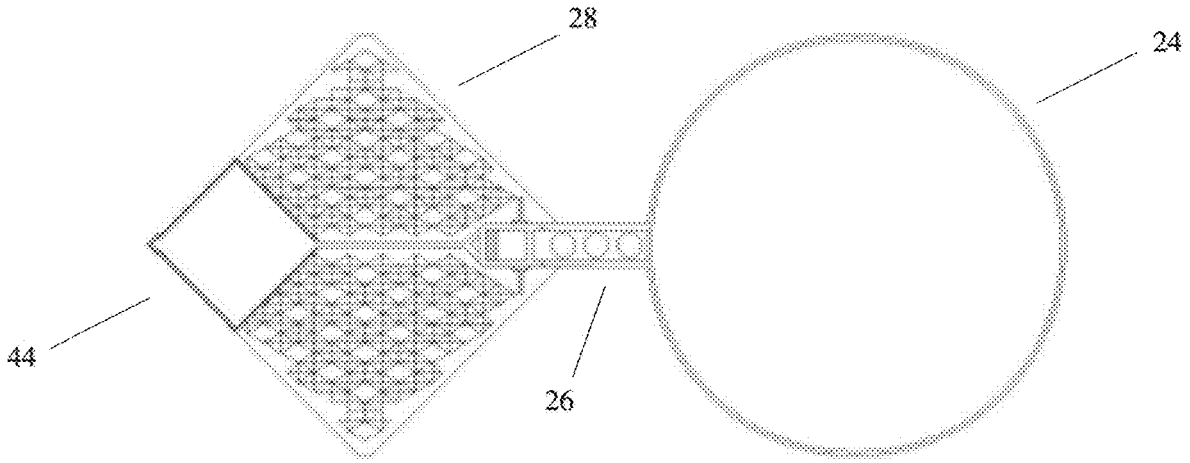
FIG. 16 is a top view of the embodiment shown in FIGS. 11-15.
Figure 17:
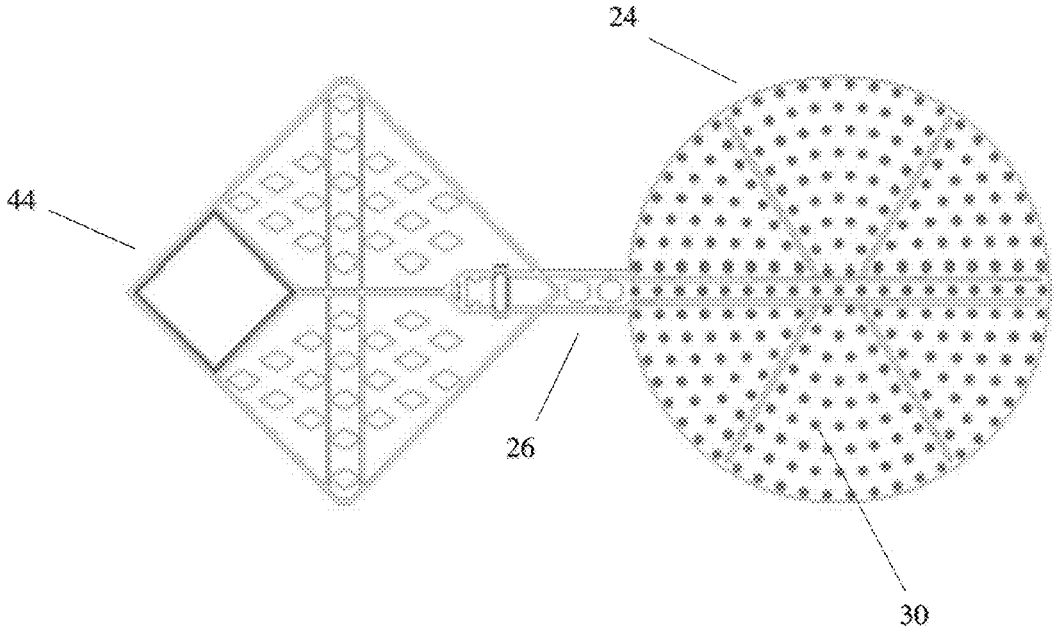
FIG. 17 is a bottom view of the embodiment shown in FIGS. 11-16.

FIGS. 11-17 show various views of the collapsible stopping device 22. FIG. 11 shows the device in the functional state, with the upper plate 24 locked into an elevated position by the locking pin 36. FIGS. 12 and 13 show opposing side views of the collapsible stopping device 22 when locked in the functional state. FIGS. 14 and 15 show opposing views of the collapsible stopping device 22 when viewed from the front and from behind, respectively, when locked in the functional state. FIGS. 16 and 17 show opposing views of the collapsible stopping device 22 when viewed from above and below, respectively, when locked in the functional state.

Figure 18:
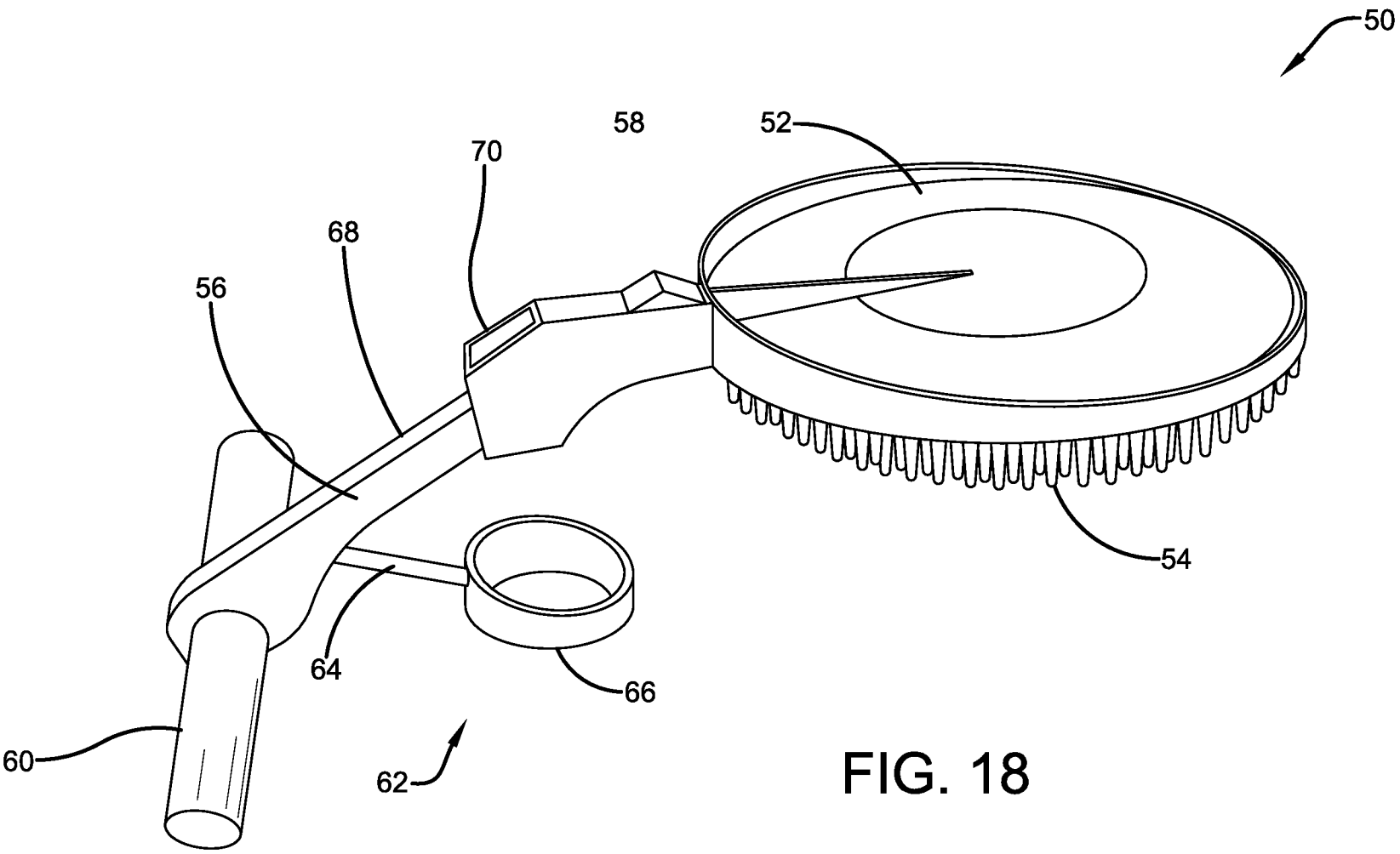
FIG. 18 is a perspective view of an alternative embodiment of the golf ball stopping device.
Figure 19:
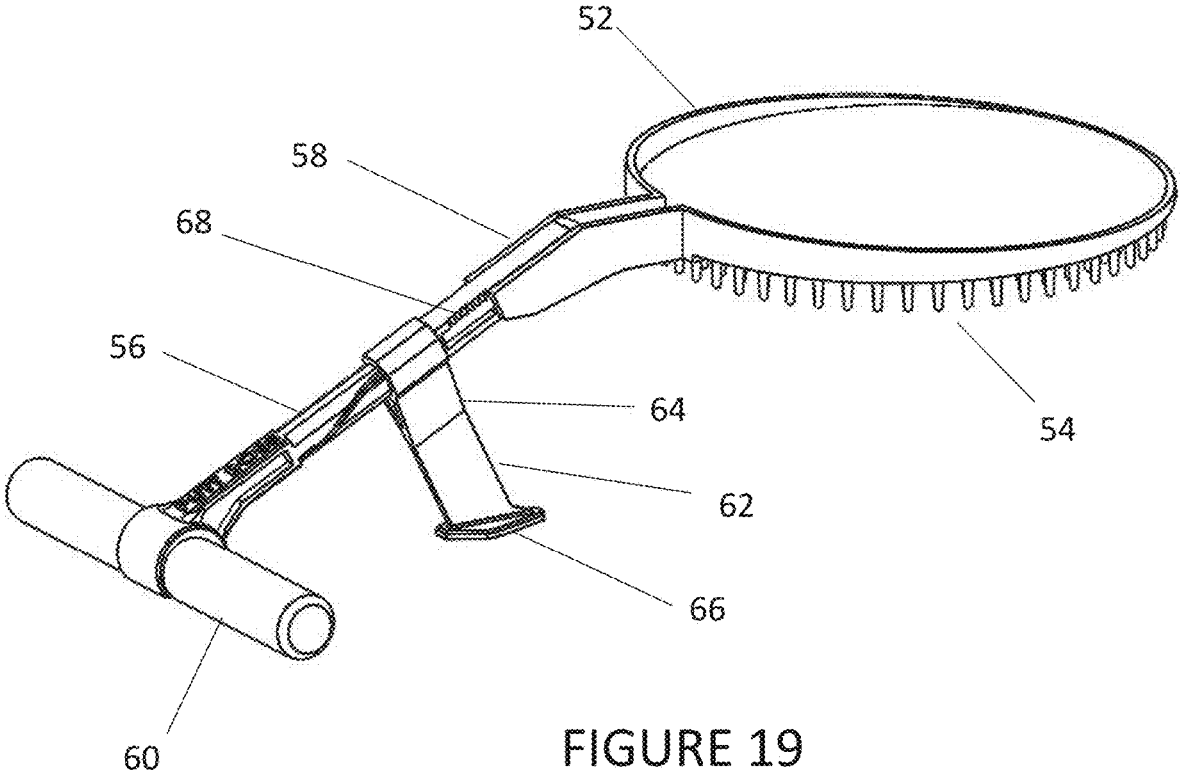
FIG. 19 is also a perspective view of the embodiment shown in FIG. 18.
Figure 20:
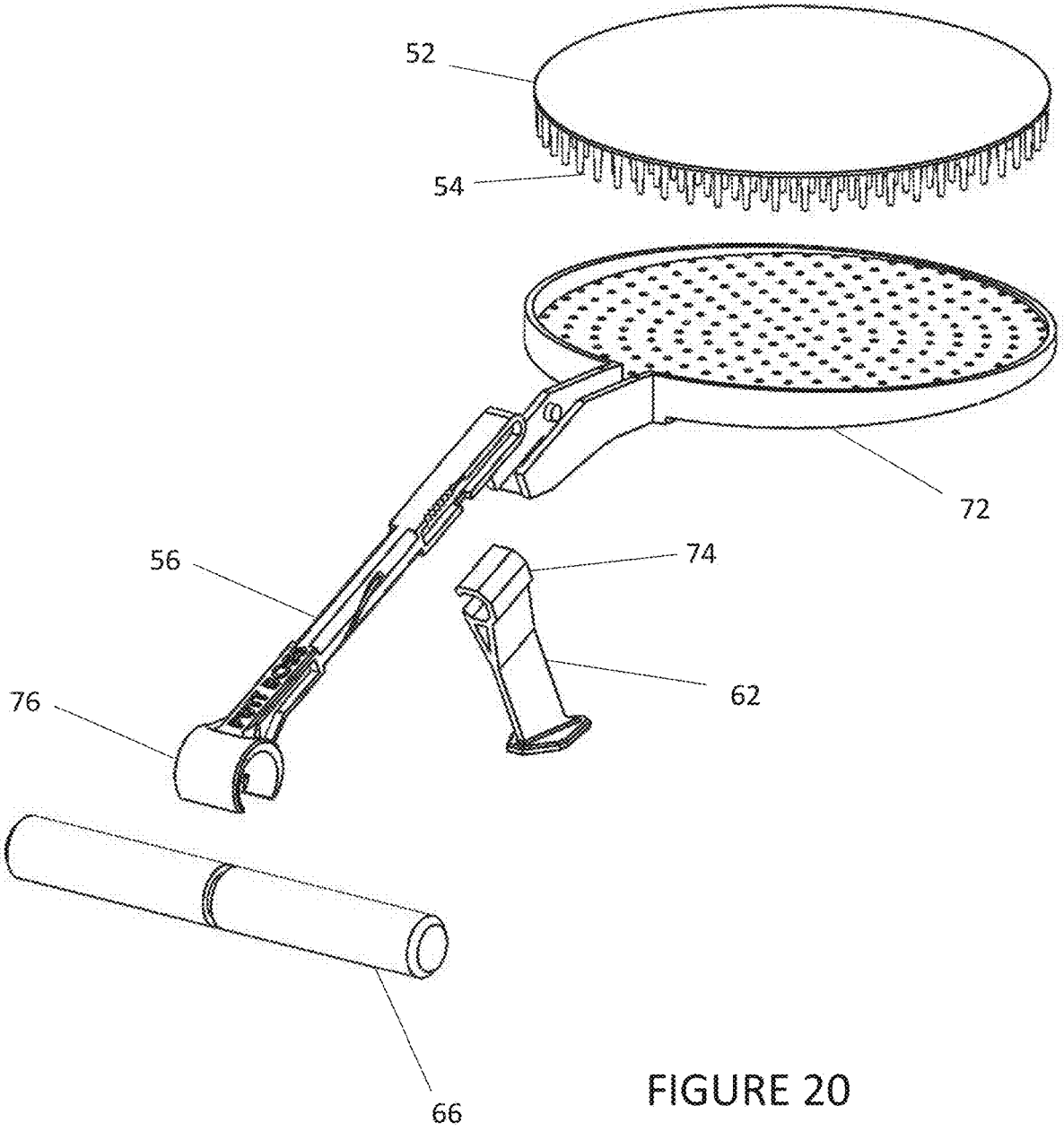
FIG. 20 shows an exploded view of the embodiment shown in FIGS. 18 and 19.

With reference now to FIG. 18, an alternative embodiment of a golf ball stopping device is shown, compact stopping device 50. The compact stopping device 50 has an upper plate 52 similar to that of the stopping plates 11 and 24 discussed above, in that the upper plate 52 may be of similar design, dimensions, and purpose as that of the stopping plates 11 and 24. The upper plate 52 is further equipped with underside surface features 54 such that the underside of the upper plate 52 is not of a uniformly smooth texture gradient (i.e., the underside of the upper plate 52 has some degree of texture or inconsistency such that it is not a smooth, continuous surface). The underside surface features 54 are similar to that of the surface features 12 and 30 discussed above, in that the underside surface features 54 may be of similar design, dimensions, and purpose as that of the surface features 12 and 30.

With continued reference to FIG. 18, the upper plate 52 is elevated above a ground surface by extension arm 56. The extension arm 56 is affixed to a base unit, anchoring rod 60, on the opposing end. The body of the extension arm 56 may exhibit a curvature between the anchoring rod 60 and the upper plate 52. According to the embodiment shown in FIG. 18, the anchoring rod 60 is approximately ½ inch in diameter and approximately 4 inches long; however, additional dimensions of the anchoring rod 64 may be used as identified by those having skill in the art. The anchoring rod 60 provides a stable base for anchoring the compact stopping device 50 to a ground surface, as well as providing a stabilizing weight to the unit so as to prevent movement upon contact with a golf ball.

Affixing the upper plate 52 to the extension arm 56 is a height adjustment mechanism 58. The height adjustment mechanism 58 allows for the upper plate 52 to be adjusted relative to the ground surface below. For example, based upon the specific terrain upon which the compact stopping device 50 is placed, the height of the upper plate 52 relative to the ground surface below may require adjusting in order to properly receive a golf ball. In order to further stabilize the compact stopping device 50, a stabilizing unit 62 may be present. According to the embodiment shown in FIG. 18, the stabilizing unit 62 is comprised of a leg 64 and a foot 66. The leg 64 may extend outward from either of the anchoring rod 60 or the extension arm 56 on a first end, with the foot 66 affixed to the second end. The connection of the leg 64 to either of the anchoring rod 60 or extension arm 56 is of a pivotable nature, allowing the stabilizing unit 62 to rotate. By rotating the stabilizing unit 62, the foot 66 may be positioned upon the ground surface such that it provides the compact stopping device 50 with a stabilizing support.

With continued reference to FIG. 18, the height adjustment mechanism 58 is a locking stair-step design. The upper surface of the extension arm 56 has a series of stair-steps, or notches 68, that continue along the contour of the extension arm 56. Connecting the extension arm 56 to the upper plate 52 is a sleeve 70. The sleeve 70 is placed over top of the extension arm 56 and may have an internal insertion mechanism that is received by the notches 68 to lock the upper plate 52 at a desired height above the ground surface. By guiding the sleeve 70 closer to the anchoring rod 60, the upper plate 52 retracts inward towards the anchoring rod 60 and, as a result of the curvature of the extension arm 56, brings the upper plate 52 closer to the ground surface (i.e., lowers the height). By guiding the sleeve 70 away from the anchoring rod 60, the upper plate 52 extends outward and away from the anchoring rod 60 and, as a result of the curvature of the extension arm 56, pushes the upper plate 52 further away from the ground surface (i.e., raises the height).

The internal insertion mechanism received by the notches 68 may be coupled with a release mechanism, such as a push release button or other similar means of disengagement. Such a means of disengagement allows for the internal insertion mechanism to be withdrawn from the notches 68 to allow the sleeve 70 to more freely traverse the extension arm 56 when selecting the desired height of the upper plate 52 relative to the ground surface. While the height adjustment mechanism 58 shown in FIG. 18 is the combination of notches 68 and sleeve 70, other mechanisms identified by those having skill in the art may be used for affixing the upper plate 52 to the extension arm 56 so as to allow for the adjustment of the height of the upper plate 52 relative to the ground surface.

With continued reference to FIG. 18, the compact stopping device 50 may be collapsible. According to one embodiment, the point of connection between the extension arm 56 and the anchoring rod 60 may be pivotable. Other collapsible features of the compact stopping device 50 may include a pivotable point of connection between the extension arm 56 and the upper plate 52, as well as a pivotable "breakpoint" somewhere along the extension arm 56. Other pivotable means may also be incorporated into the design of the compact stopping device 50 as identified by those having skill in the art. Regardless of the exact nature of the pivotable means employed, such pivotable means may be generally defined by their ability to allow the upper plate 52 to be "swung" in towards either of the extension arm 56 or the anchoring rod 60, so as to significantly decrease the overall size of the compact stopping device 50.

Figure 21:
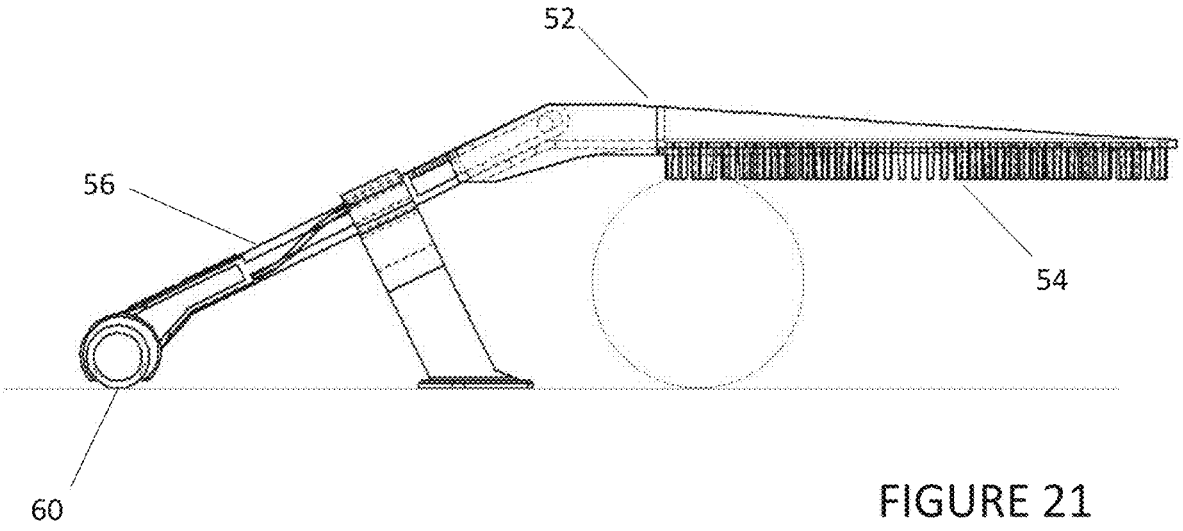
FIG. 21 shows a side profile in an operative state of the embodiment shown in FIGS. 18-20.
Figure 22:
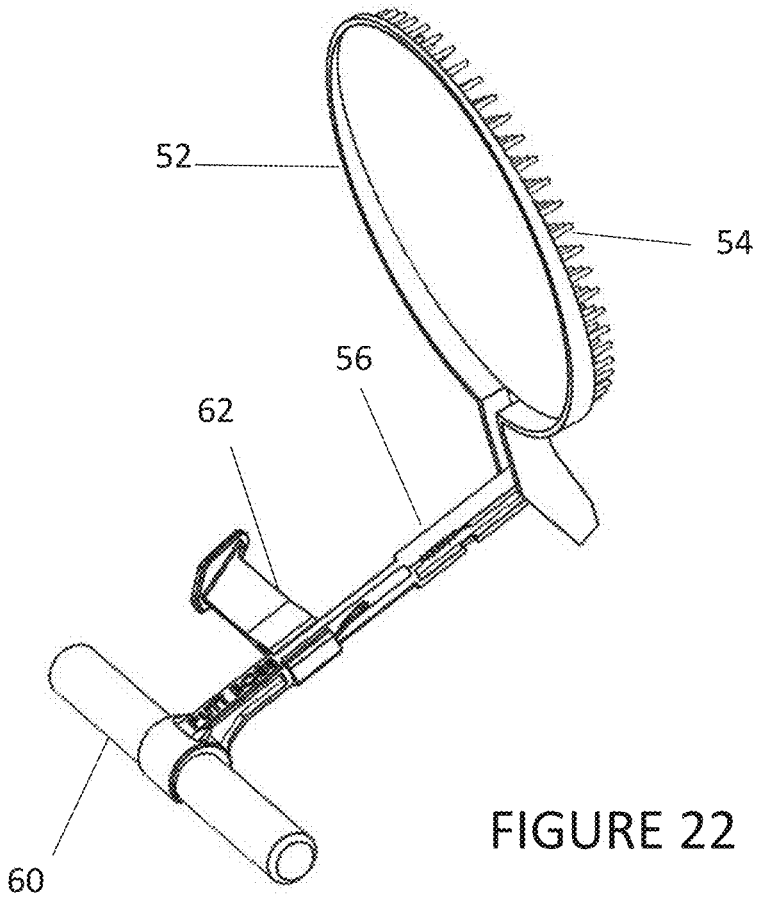
FIG. 22 is a perspective view of the golf ball stopping device shown in FIGS. 18-21 in a partially-collapsed state.
Figure 23:
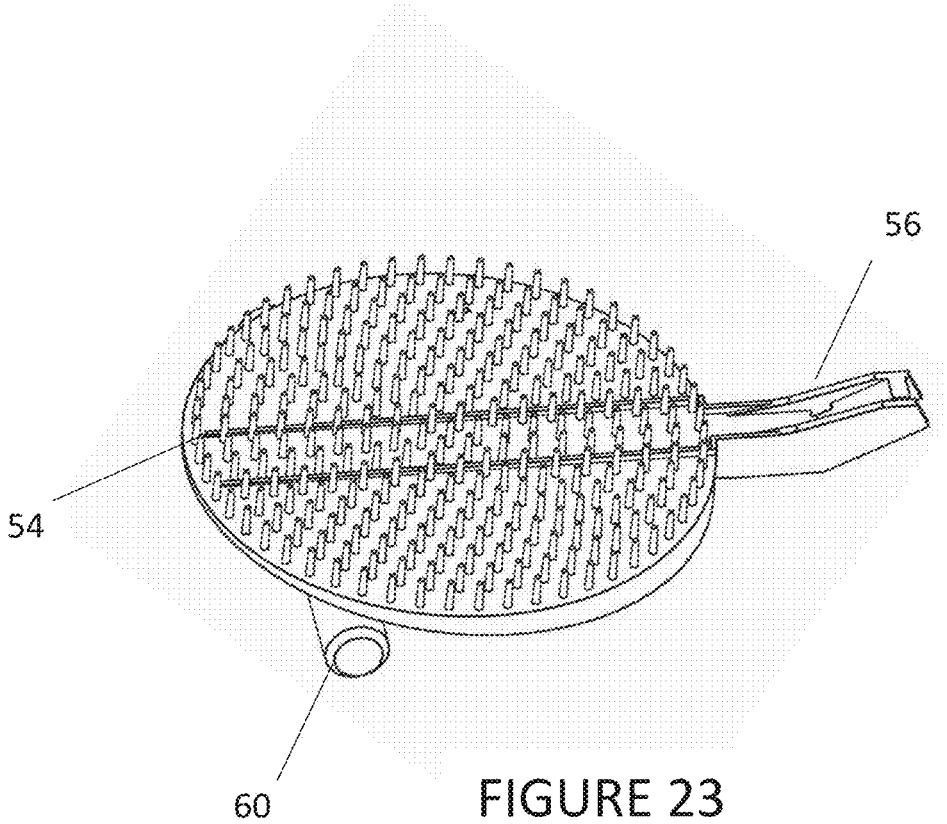
FIG. 23 is a perspective view of the golf ball stopping device shown in FIGS. 18-22 in a collapsed state.

FIGS. 19-28 show various views of an embodiment of the compact stopping device 50 similar to that shown in FIG. 18, where like reference numerals refer to like components. As shown in the exploded view of FIG. 20, the upper plate 52 can be received within a lower plate 72, which is affixed to the extension arm 56. The lower plate 72 includes an array of holes that admit the underside surface features 54. The stabilizing unit 62 includes a first gripping portion 72 for engaging the extension arm 56. Similarly, the extension arm 56 itself includes a second gripping portion 74 for engaging the anchoring rod 60. FIG. 21 shows the compact stopping device 50 in an operative state, stopping a golf ball in the underside surface features 54. With reference now to FIG. 22, the compact stopping device 50 is shown in a partially collapsed state. FIG. 23 shows the compact stopping device 50 in a fully collapsed state.

Figure 24:
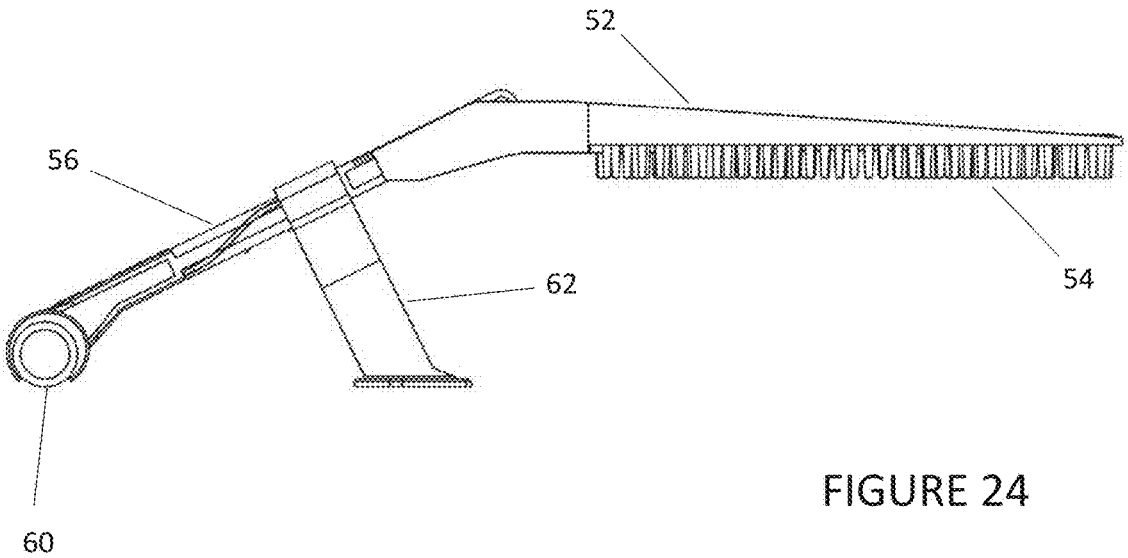
FIG. 24 shows a side profile of the embodiment shown in FIGS. 18-23.
Figure 25:
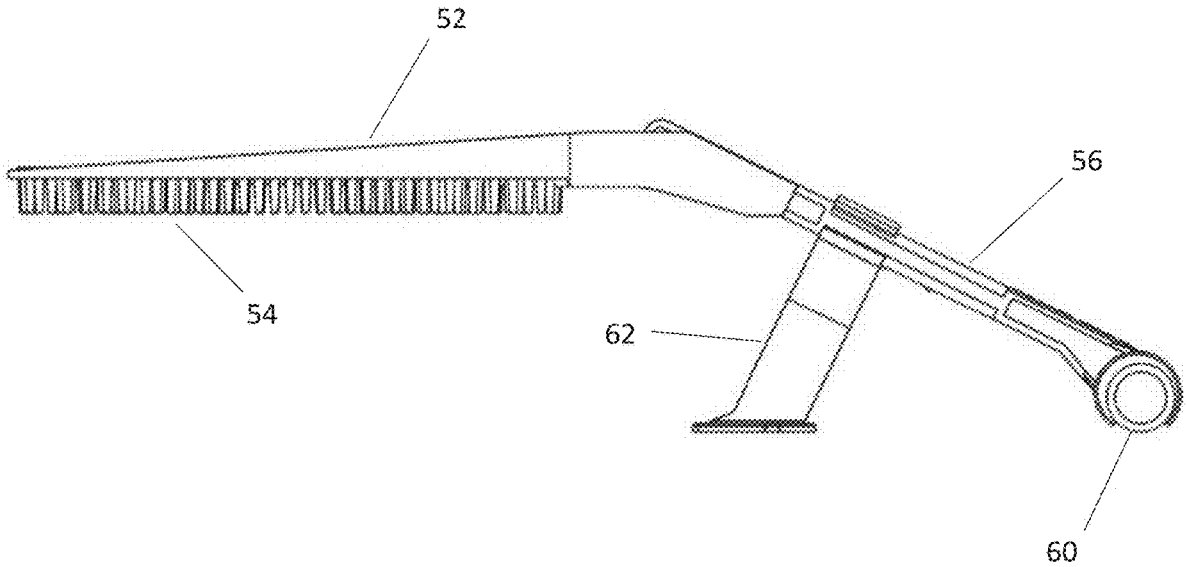
FIG. 25 shows an alternative side profile of the embodiment shown in FIGS. 18-24.
Figure 26:
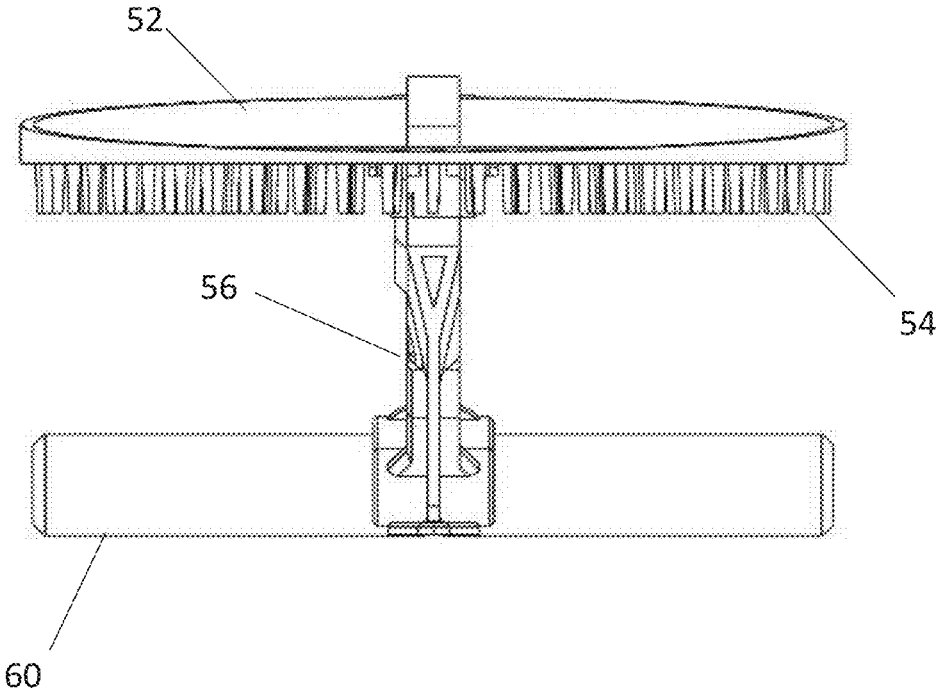
FIG. 26 is a front view of the embodiment shown in FIGS. 18-25.
Figure 27:
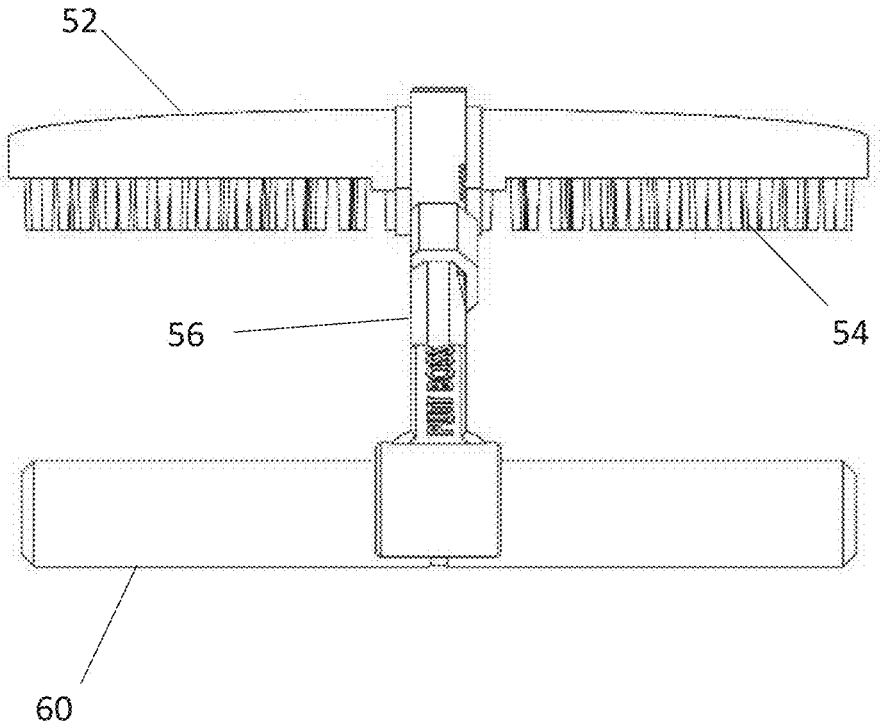
FIG. 27 is a back view of the embodiment shown in FIGS. 18-26.
Figure 28:
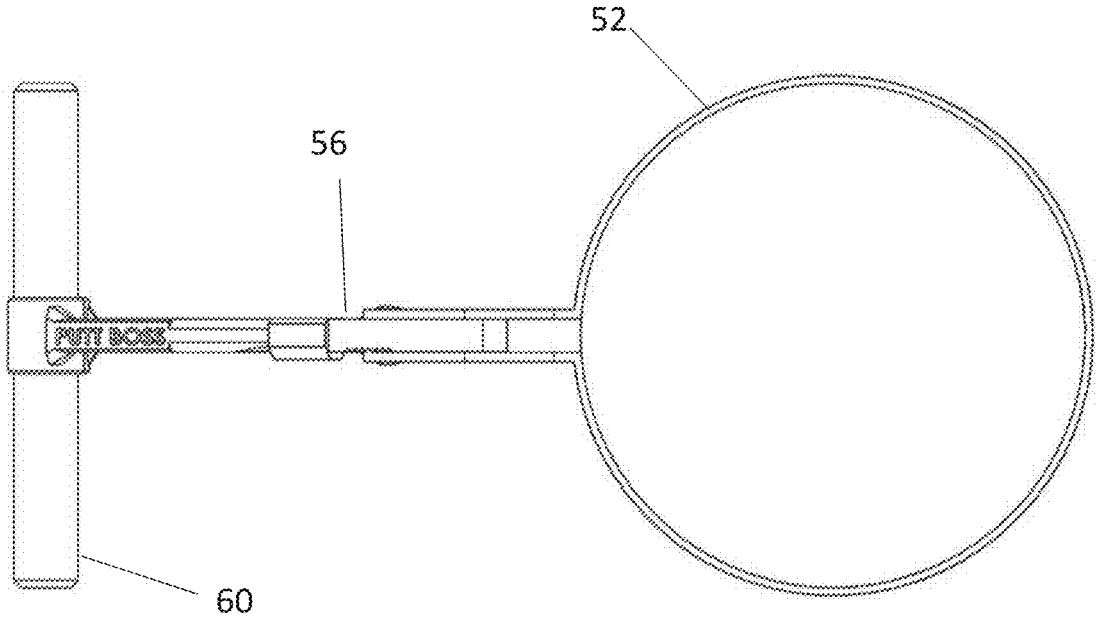
FIG. 28 is a top view of the embodiment shown in FIGS. 18-27.
Figure 29:
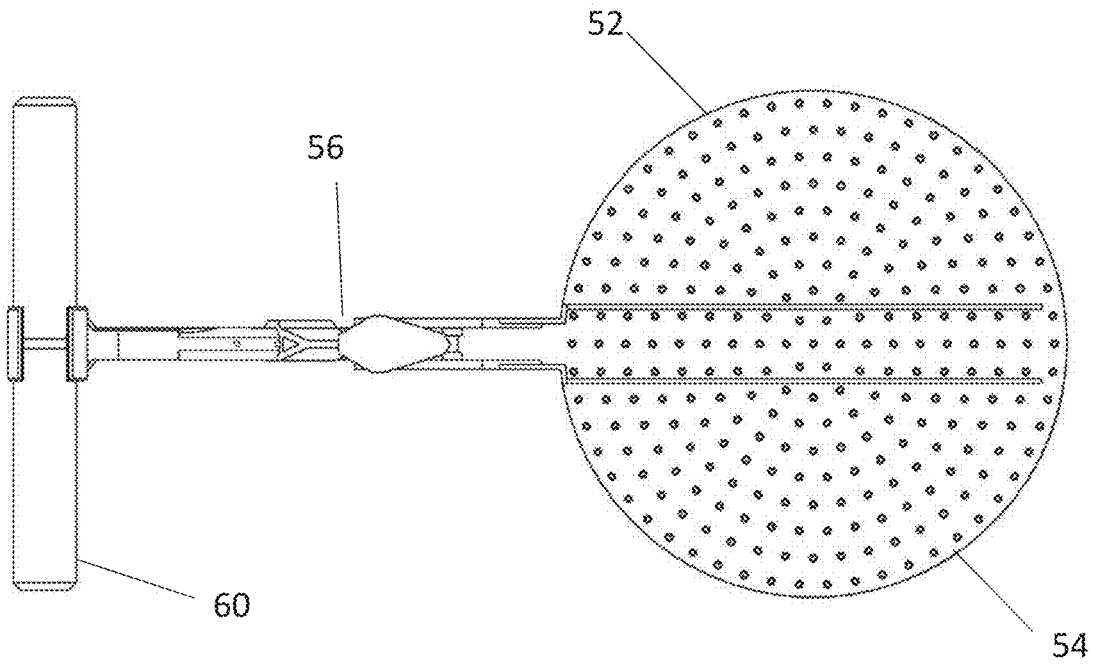
FIG. 29 is a bottom view of the embodiment shown in FIGS. 18-28.

FIGS. 24-29 show various views of the compact stopping device 50. FIGS. 24 and 25 show opposing side views of the collapsible stopping device 50 in the functional state. FIGS. 26 and 27 show opposing views of the compact stopping device 50 when viewed from the front and from behind, respectively, when in the functional state. FIGS. 28 and 29 show opposing views of the compact stopping device 50 when viewed from above and below, respectively, when in the functional state.

As described above, the present disclosure has been described in association with various aspects thereof and it is understood that many changes and modifications to the described aspects can be carried out without departing from the scope and the spirit of the present disclosure that is intended to be limited only by the appended claims.

Having thus described the invention, it is now claimed:

What is claimed is:

1. A collapsible device for stopping a rolling ball, comprising:

a base;

an upper plate, where the underside of the upper plate is not of a uniform texture gradient;

an extension arm connected about a first end to the base and about a second end to the upper plate;

a height adjustment mechanism for adjusting the positioning of the upper plate;

a stabilizing unit; and, at least one pivotable connection point at at least one of the first end or the second end of the extension arm that allows the upper plate to be pivotally swung towards at least one of the extension arm or the base;

wherein the base is placed about a surface, the height adjustment mechanism adjusts the height of the upper plate relative to the surface, and a rolling ball passing under the upper plate will be trapped by the underside of the upper plate.

2. The device of claim 1, wherein the upper plate is substantially round and approximately the size of a golf putting hole.

3. The device of claim 1, wherein the underside of the upper plate has a series of bristles.

4. The device of claim 1, wherein the stabilizing unit is an anchor weight.

5. The device of claim 4, wherein the base is placed over top of the anchor weight.

6. The device of claim 1, wherein the extension arm is substantially straight and extends upward and away from the base at an approximately 90 degree angle.

7. The device of claim 6, wherein the at least one pivotable connection point of the extension arm comprises the connection of the extension arm to the base.

8. The device of claim 7, wherein the at least one pivotable connection point of the extension arm comprises the connection of the extension arm to the upper plate.

9. The device of claim 8, wherein the height adjustment mechanism has a locking pin to secure the upper plate at a desired height above the surface.

10. The device of claim 9, wherein the pivotable connection of the extension arm and base allows the extension arm to fold substantially flat such that the base and extension arm are substantially parallel to one another.

11. The device of claim 10, wherein the pivotable connection of the extension arm and upper plate allows the upper plate to fold substantially flat such that the upper plate and base are substantially parallel to one another.

12. The device of claim 1, wherein the base is an anchoring rod.

13. The device of claim 12, wherein the stabilizing unit is comprised of a leg and a foot.

14. The device of claim 13, wherein the extension arm has a curvature of at 30 degrees.

15. The device of claim 14, wherein the extension arm has a series of notches for receiving an insertion member of the height adjustment mechanism.

16. The device of claim 15, wherein the height adjustment mechanism lowers height of the upper plate relative to the ground by retracting towards the base.

17. The device of claim 16, wherein the connection of the extension arm to the base is pivotable.

18. The device of claim 17, wherein the connection of the extension arm to the upper plate is pivotable.

19. A collapsible device for stopping a rolling ball, comprising:

a base;

an upper plate, where the upper plate is substantially round, approximately the size of a golf putting hole, and the underside has a series of bristles not of a uniform texture gradient;

an extension arm pivotably connected about a first end to the base and about a second end to the upper plate, wherein the extension arm is substantially straight and extends upward and away from the base at an approximately 90 degree angle;

a height adjustment mechanism for adjusting the position of the upper plate having a locking pin to secure the upper plate in a desired position;

a stabilizing unit, where the stabilizing unit is an anchor weight positioned underneath the base; and, at least one pivotable connection point at at least one of the first end or the second end of the extension arm that allows the upper plate to be pivotally swung towards at least one of the extension arm or the base;

wherein the base is placed about a surface, the height adjustment mechanism adjusts the height of the upper plate relative to the surface, and a rolling ball passing under the upper plate will be trapped by the underside of the upper plate.

20. A collapsible device for stopping a rolling ball, comprising:

a base, wherein the base is an anchoring rod;

an upper plate, where the upper plate is substantially round, approximately the size of a golf putting hole, and the underside has a series of bristles not of a uniform texture gradient;

an extension arm having a curvature of at least 30 degrees pivotably connected about a first end to the base and about a second end to the upper plate, wherein the extension arm has a series of notches for receiving an insertion member;

a height adjustment mechanism for adjusting the positioning of the upper plate, wherein the height adjustment mechanism lowers the height of the upper plate relative to the ground by retracting towards the base;

a stabilizing unit, wherein the stabilizing unit is comprised of a leg and a foot; and, at least one pivotable connection point that allows the upper plate to move closer to the base;

wherein the base is placed about a surface, the height adjustment mechanism adjusts the height of the upper plate relative to the surface, and a rolling ball passing under the upper plate will be trapped by the underside of the upper plate.

* * * * *